US006886810B2

(12) United States Patent
Forrester

(10) Patent No.: US 6,886,810 B2
(45) Date of Patent: May 3, 2005

(54) NAIL PULLER

(76) Inventor: Joseph Forrester, 5073 Bristol Ind. Way #STEA, Buford, GA (US) 30518

( * ) Notice: Subject to any disclaimer, the term of this patent is extended or adjusted under 35 U.S.C. 154(b) by 0 days.

(21) Appl. No.: 10/668,608

(22) Filed: Sep. 24, 2003

(65) Prior Publication Data

US 2005/0062025 A1 Mar. 24, 2005

(51) Int. Cl.[7] ..... B66F 15/00
(52) U.S. Cl. ..... 254/22
(58) Field of Search ..... 254/22, 23, 21, 254/30, 132

(56) References Cited

U.S. PATENT DOCUMENTS

| | | | |
|---|---|---|---|
| 6,283 | A | 4/1849 | Bryant |
| 270,085 | A | 1/1883 | Lewis |
| 501,919 | A | 7/1893 | Capewell |
| 855,522 | A | 6/1907 | Mattocks |
| 943,322 | A | 12/1909 | Soles |
| 1,156,870 | A | 10/1915 | Aiazzi |
| 1,193,376 | A | 8/1916 | Goben |
| 4,997,163 | A | 3/1991 | Henning |
| 6,105,935 | A | 8/2000 | Wagner |
| 2002/0056832 | A1 | 5/2002 | Wagner |

*Primary Examiner*—Robert C. Watson
(74) *Attorney, Agent, or Firm*—Shoemaker and Mattare

(57) ABSTRACT

A nail puller comprises a base plate and a lever arm attached to the base plate. A pair of replaceable toothed gripping jaws are attached to the base plate and the lever arm respectively, the teeth being aligned so that the teeth pull a nail by its shank, rather than by its head, when force is applied to the lever.

7 Claims, 6 Drawing Sheets

NAIL PULLER

BACKGROUND OF THE INVENTION

This invention relates to a nail puller of the type having relatively movable jaws for gripping a nail by its shank and a lever arm for exerting a pulling force on the nail.

Of the many types of nail pulling tools, the most well known is the claw hammer. Almost everyone has used a claw hammer to pull nails, and many are aware of the limitations of that tool for the function of pulling nails. Despite the many configurations of the claw, none successfully pulls nails with every attempt. This is so in part because the nail pulling structure (the claw) is integral with the nail driving structure (the head); this imposes geometric constraints on the design of the claw. Also, because the claw is designed to engage the head of the nail, it is of little or no use when a nail's head has been broken off or badly damaged, or if the head is small, as with a finishing nail. And because the head must be engaged, the claw sometimes reaches its limit of travel before the nail is extracted, in which case one has to use another tool, or place a shim under the hammer head, to finish pulling the nail. Other tools, such as pry bars having nail pulling features, suffer the same deficiencies, even though they may provide a longer stroke.

Another characteristic of claw-type nail pullers is that they pull the nail at an angle to the axis along which the nail was driven initially. This angularity increases the friction between the nail shank and the hole, causing an unnecessary increase in the required pulling force.

SUMMARY OF THE INVENTION

An object of the invention is to provide a nail puller or extractor that overcomes the deficiencies of claw-type pulling devices like claw hammers and pry bars.

Another object is to improve leverage of a nail pulling tool.

A further object is to provide a device which can pull headless nails or nails with small or damaged heads.

Yet another object is to reduce the effort of pulling nails by reducing the angularity of the pulling force with respect to the axis of the nail.

It is also an object to provide a tool which accomplishes the foregoing objects, yet is of simple design to that it may be manufactured at a modest cost.

These and other objects are attained by a nail puller as described below.

BRIEF DESCRIPTION OF THE DRAWINGS

In the accompanying drawings.

DESCRIPTION OF THE PREFERRED EMBODIMENT

Figure 1:
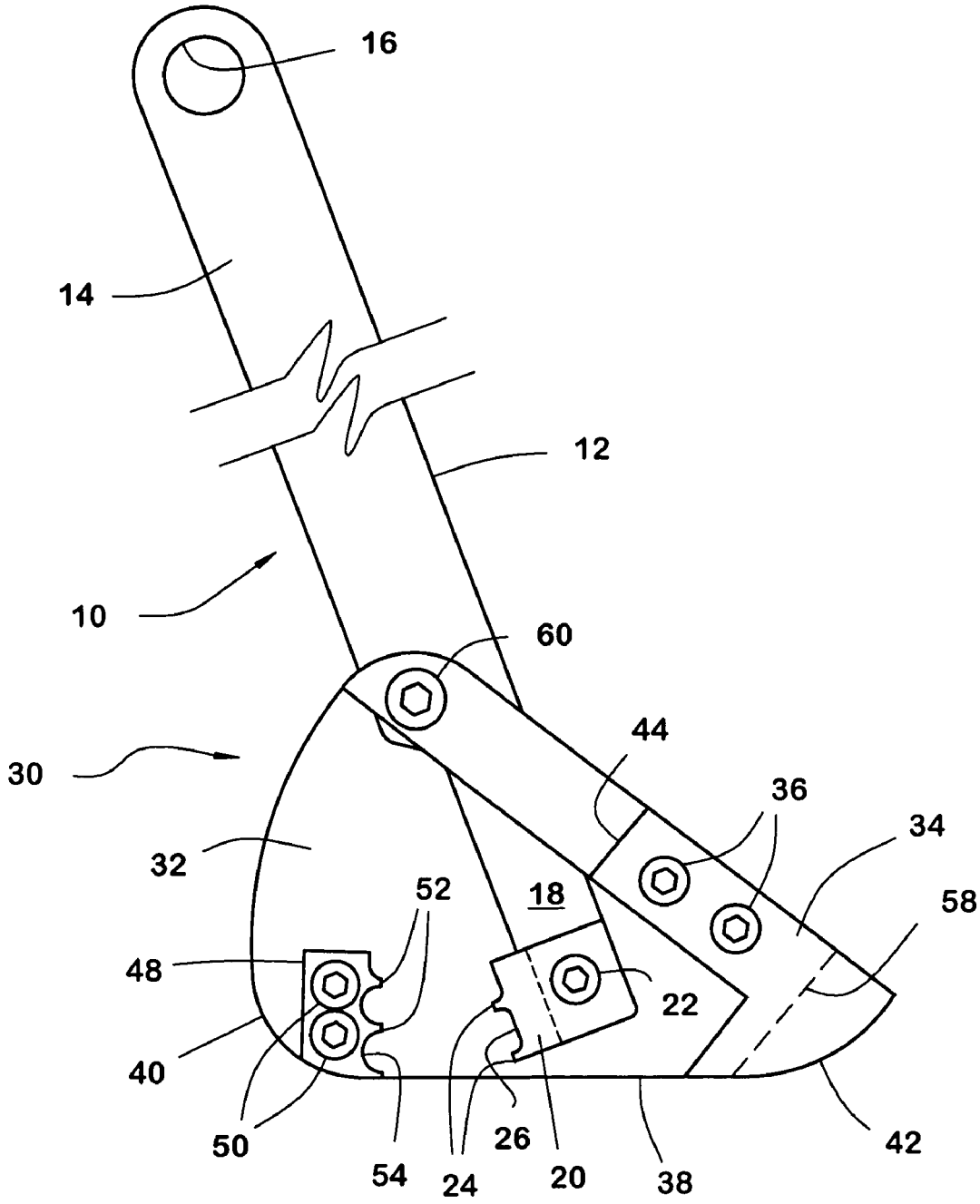
FIG. 1 is a side elevation of a nail puller embodying the invention, showing the puller with its jaws open.

A nail puller embodying the invention (FIGS. 1–2) has two relatively movable parts: an arm assembly 10 and a base assembly 30 interconnected by a shoulder screw 60 which functions as a hinge pin.

The arm assembly 10 includes an arm 12 of suitable length, for example eighteen inches. The arm may have perforations (not illustrated) for decoration or for a practical purpose such as weight reduction or for facilitating attachment to a tool belt. The arm 12 has an upper end 14 fitted with a handle 16 to provide a comfortable grip, and a lower end 18 of reduced width.

A first gripping jaw 20 is affixed to the lower end of the arm by a removable fastener such as a machine screw 22. The jaw 20 has teeth 24 formed along its gripping surface. The groove 26 between the teeth is sufficiently deep to avoid bearing against the head of a nail grasped by the jaw. The shoulder screw 60 passes through a hole in the arm at an intermediate pivot point.

Figure 3:
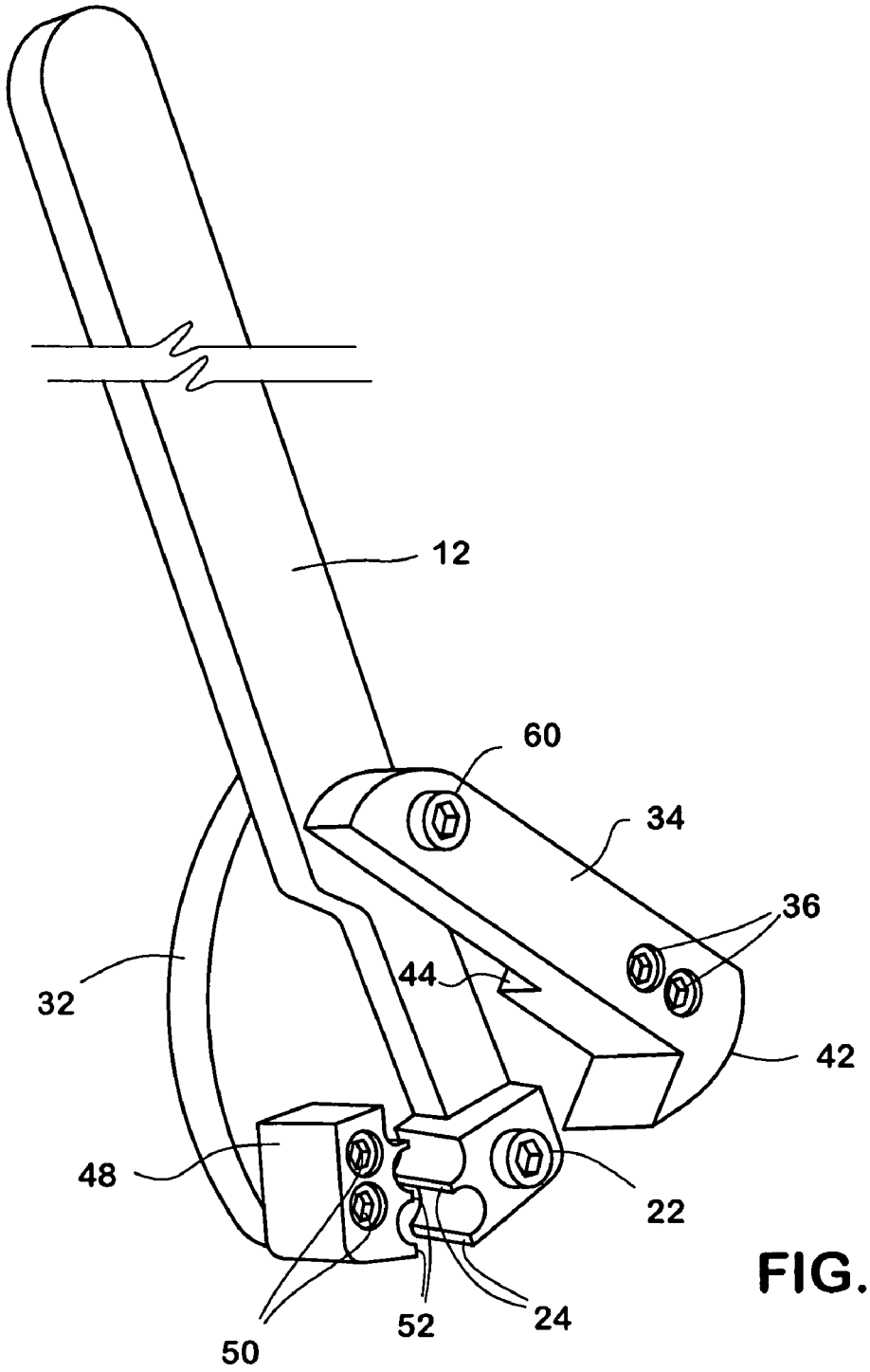
FIG. 3 is a perspective view, showing the jaws partially closed.

The base assembly 30 comprises a base plate 32 and a rocker plate 34 immovably attached to the base plate, preferably by screws 36. Alternatively, the parts 32, 34 may be welded together or made as one piece. The base plate has a flat bottom surface 38 upon which the tool rests when a nail is being engaged, and a round heel 40. The rocker plate 34 has a rounded toe 42 upon which the puller pivots when the nail is being pulled. The shoulder 44 (FIG. 3) on the rocker plate defines the lower end of a slot 46 between the base plate and the rocker plate. The slot allows the lower end 18 of the arm to pivot about the screw 60.

Figure 2:
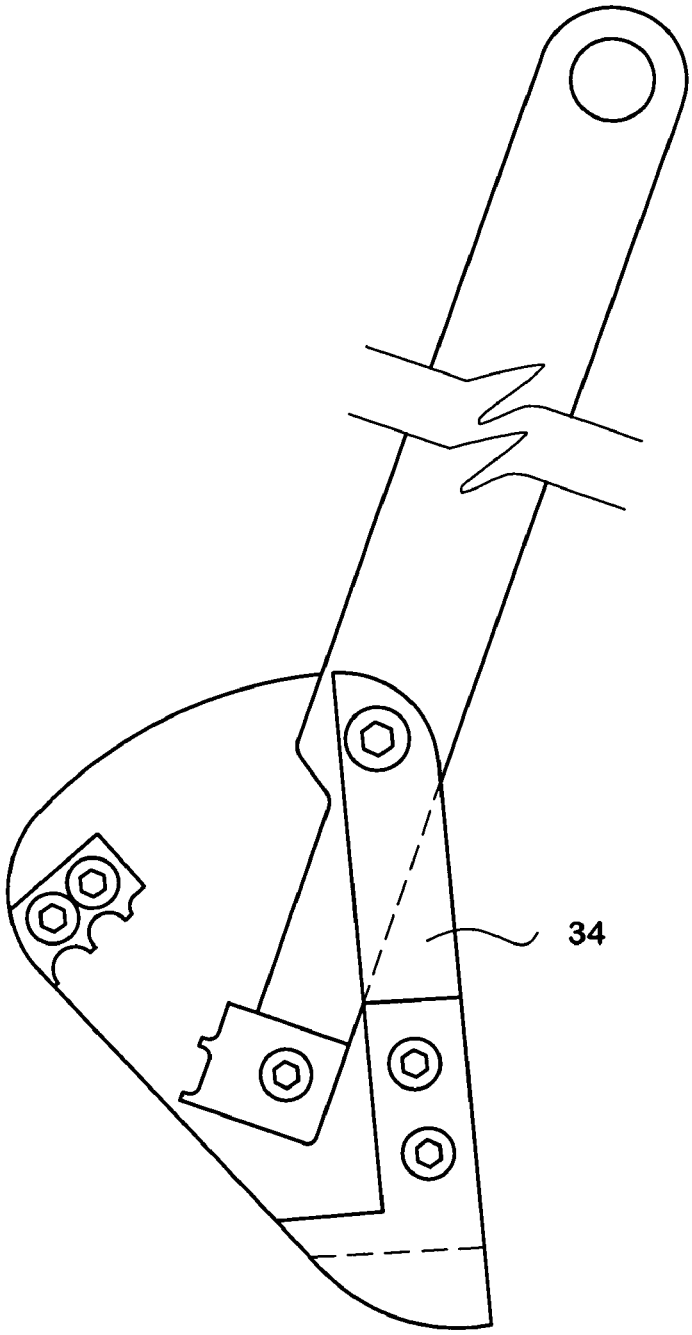
FIG. 2 is a side elevation showing the jaws closed.

A second gripping jaw 48 is attached to the base plate 32 by removable fasteners such as machine screws 50. It is positioned so that its teeth 52 oppose the teeth 14 of the first gripping jaw 20 when the tool is in its gripping configuration (FIG. 2). The grooves 54 between the teeth avoid contact with a nail head.

The fact that the jaws can be replaced when they are worn substantially prolongs the useful life of the tool.

Figure 4:
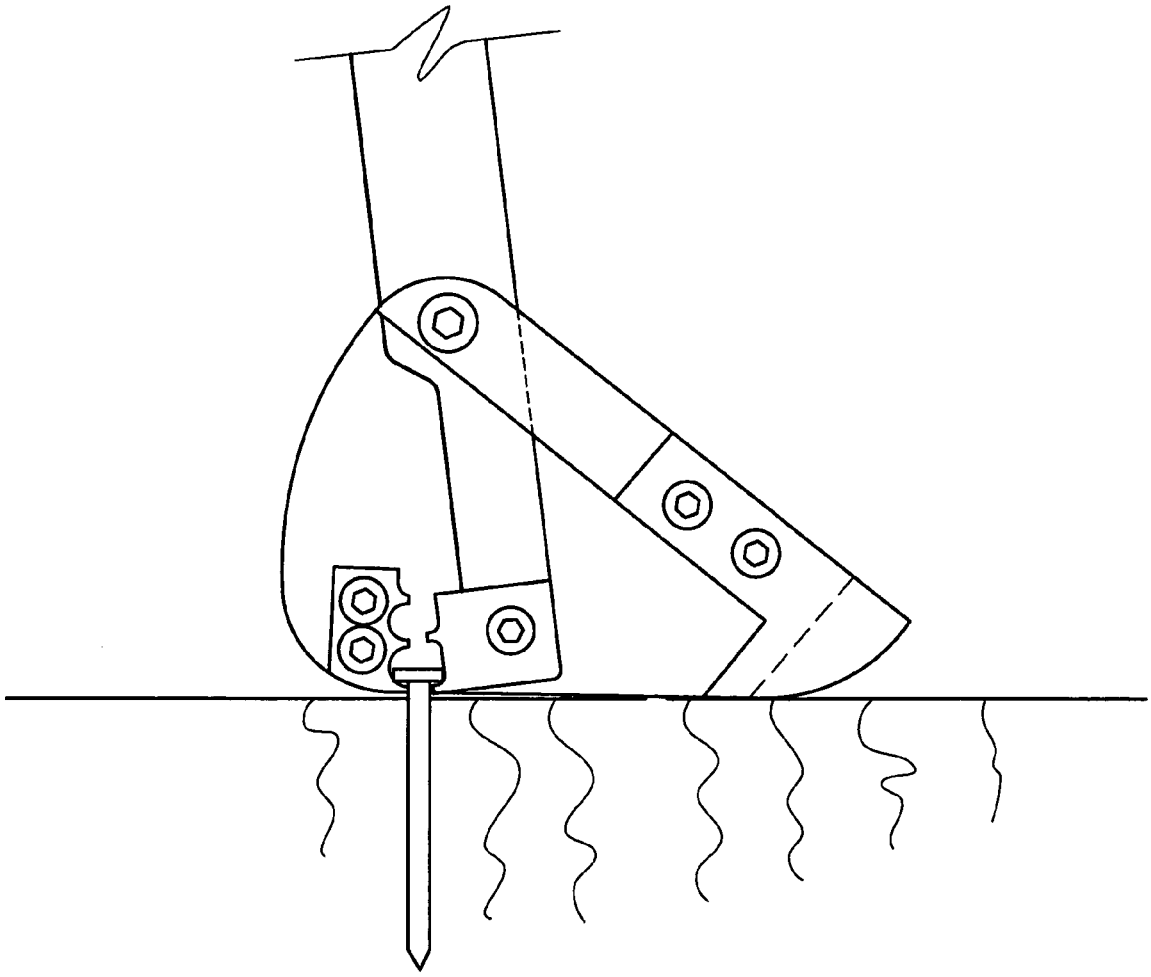
FIG. 4 is a side elevation, showing the tool engaging a nail.
Figure 5:
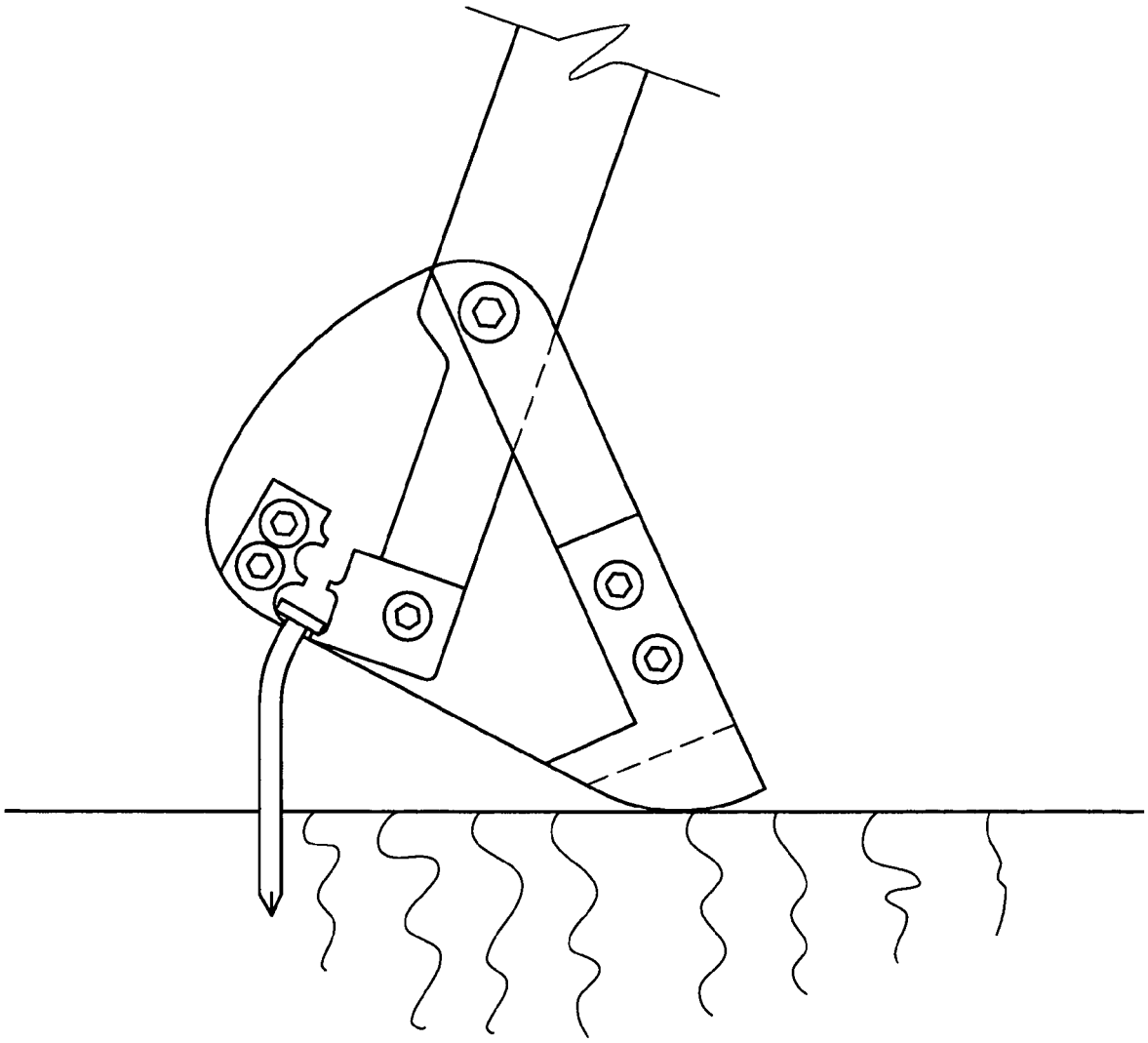
FIG. 5 is a side elevation, showing the tool pull the nail by its shank.

In operation, the tool is placed with the jaws astride the head of a nail, and the lever is moved so as to bring the jaws together. FIGS. 4–5 show the pulling sequence of the tool, illustrated with a nail protruding slightly from a work surface such as a board. As a manual horizontal force is applied to the handgrip (FIG. 4), a much greater gripping force is applied to the shank of a nail by the gripping jaws. The ratio of the distance between the handle 16 and the jaw 20 to the distance between the toe 42 and the jaw 20 is much greater than the inverse of the coefficient of friction between the nail and the jaws. This ratio is preferably at least 4:1. Therefore, more than enough gripping force is developed to pull the nail by its shank without slipping (FIG. 5), even if the nail is headless. It can also be noted that the pulling direction is more in line with the axis of the nail than would be the case with a claw hammer. This is because of the large distance from the jaws to the pivot point (the toe 42). Thus, friction between the nail shank and the nail hole is minimized.

The placement of the shoulder screw or hinge pin on the lower end of the arm just above the gripping jaw 42 allows the tool to be placed directly over a nail regardless of how far the nail initially protrudes from the surface.

One can see that, for a nail to be engaged initially, its head must already be above the surface from which the nail is being pulled. If the nail head is embedded, it must be lifted slightly. Special tools exist for performing this function.

Figure 6:
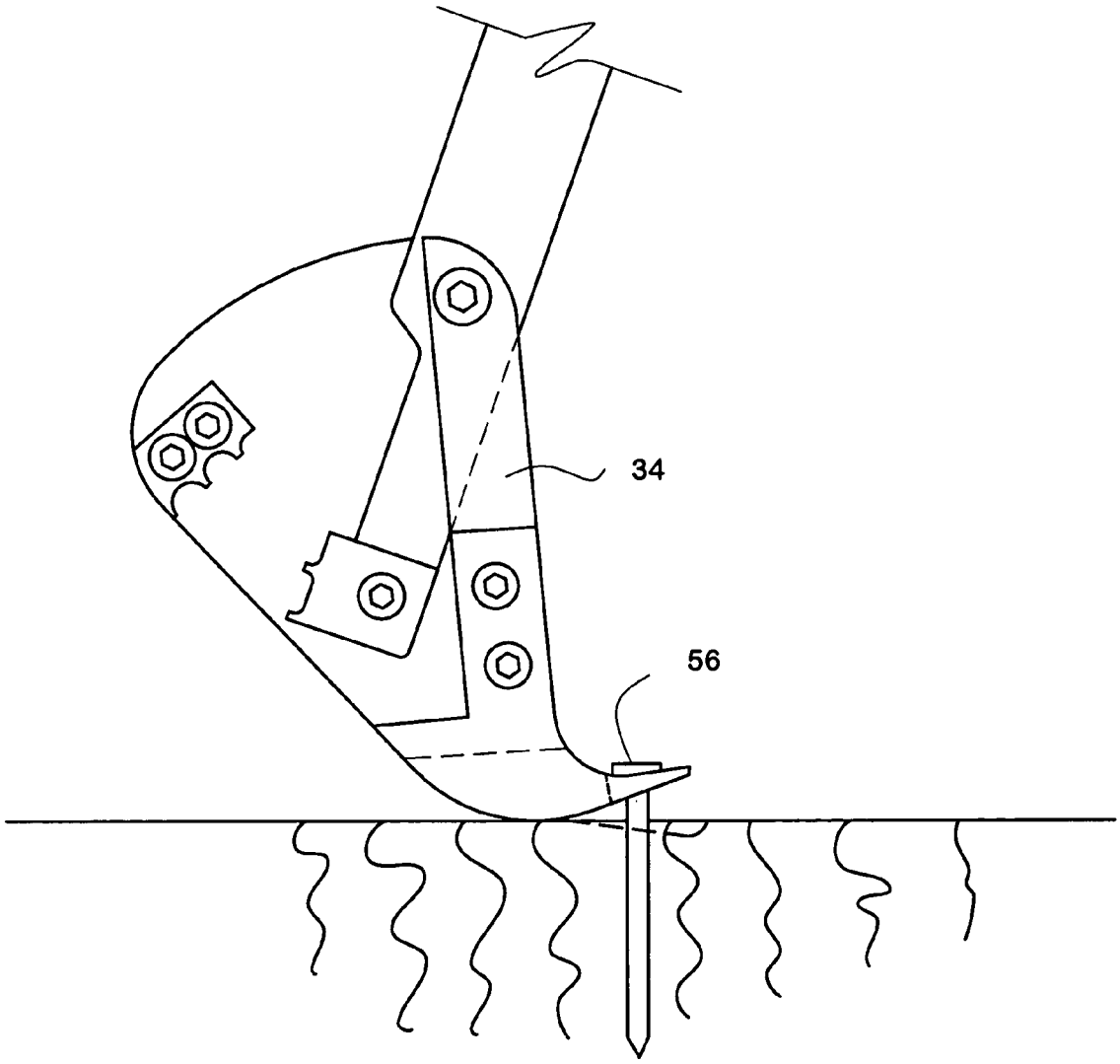
FIG. 6 shows a modified form of the invention, having a tail or claw for lifting embedded nail heads.

They typically have a shallow notch located in the center of a short, tapered lever surface that is designed to be driven into the wood just beneath the nail head, and then with a relatively short stroke, to raise the nail a short distance. Such a tool may be formed as part of the tool of this invention, as for example in the modification shown in FIG. 6, where the nail lifter is indicated by numeral 56.

The broken line 58 in FIGS. 1 and 2 indicates a slot formed in the middle of the toe 42. This slot provides stability when the nail being extracted lies at an acute angle to the surface, or is at the corner or edge of a board or plank.

Since the invention is subject to variations, the foregoing description and the accompanying drawings are merely illustrative of the invention defined by the following claims.

I claim:

1. A nail puller comprising a lever arm having a handle at one end and a portion of reduced width at its other end, a base assembly comprising a base plate and a rocker plate, said rocker plate having a rounded toe for engaging a work surface, means for pivotally connecting the lever arm to the base plate, a first gripping jaw affixed to the lever arm, and having at least one tooth adapted to engage the shank of a nail, a second gripping jaw affixed to the base plate at a distance from said toe, and having at least one tooth adapted to engage the shank of a nail at a point opposite a corresponding tooth on the first gripping jaw, whereby, when a nail shank is situated between said opposed teeth and a manual force is applied to said handle in the direction of the toe, a gripping force is applied the nail shank while the base plate pivots about a line of contact between the toe and the work surface, to pull the nail from the surface, wherein each jaw has plural teeth with grooves between adjacent teeth, said grooves being of sufficient depth to avoid contact with the head of a nail whose shank is grasped by said teeth.

2. A nail puller comprising a lever arm having a handle at one end and a portion of reduced width at its other end, a base assembly comprising a base plate and a rocker plate, said rocker plate having a rounded toe for engaging a work surface, means for pivotally connecting the lever arm to the base plate, a first gripping jaw affixed to the lever arm, and having at least one tooth adapted to engage the shank of a nail, a second gripping jaw affixed to the base plate at a distance from said toe, and having at least one tooth adapted to engage the shank of a nail at a point opposite a corresponding tooth on the first gripping jaw, whereby, when a nail shank is situated between said opposed teeth and a manual force is applied to said handle in the direction of the toe, a gripping force is applied the nail shank while the base plate pivots about a line of contact between the toe and the work surface, to pull the nail from the surface, wherein the rocker plate has a slot in its toe for stabilizing the nail puller when a nail is being pulled from the edge of a board.

3. The invention of claim 1, further comprising a nail lifter for raising embedded nail heads from the work surface.

4. A nail puller comprising a lever arm having a handle at one end and a portion of reduced width at its other end, a base assembly comprising a base plate and a rocker plate, said rocker plate having a rounded toe for engaging a work surface, means for pivotally connecting the lever arm to the base plate, a first gripping jaw affixed to the lever arm, and having at least one tooth adapted to engage the shank of a nail, a second gripping jaw affixed to the base plate at a distance from said toe, and having at least one tooth adapted to engage the shank of a nail at a point opposite a corresponding tooth on the first gripping jaw, whereby, when a nail shank is situated between said opposed teeth and a manual force is applied to said handle in the direction of the toe, a gripping force is applied the nail shank while the base plate pivots about a line of contact between the toe and the work surface, to pull the nail from the surface, wherein the ratio of the distance between the handle and the first gripping jaw to the distance between the toe and the first gripping jaw is greater than the inverse of the coefficient of friction between the nail and the teeth.

5. The invention of claim 4, wherein said ratio is at least 4:1.

6. A nail puller comprising a lever arm having a handle at one end and a portion of reduced width at its other end, a base assembly comprising a base plate, means for pivotally connecting the lever arm to the base plate, a first gripping jaw affixed to the lever arm by at least one removable fastener, and having at least one tooth adapted to engage the shank of a nail, a second gripping jaw affixed to the base plate by at least one removable fastener, and having at least one tooth adapted to engage the shank of a nail at a point opposite a corresponding tooth on the first gripping jaw, said removable fasteners enabling one to replace said jaws when they are worn.

7. The invention of claim 6, wherein said removable fasteners are machine screws.

* * * * *